US006170770B1

(12) United States Patent
Rich, Jr.

(10) Patent No.: US 6,170,770 B1
(45) Date of Patent: Jan. 9, 2001

(54) PROCESS AND APPARATUS FOR PREPARING FEEDSTOCK FOR A COAL GASIFICATION PLANT

(76) Inventor: John W. Rich, Jr., R.D. #1, Box 211, Auburn, PA (US) 17922

( * ) Notice: Under 35 U.S.C. 154(b), the term of this patent shall be extended for 0 days.

(21) Appl. No.: 09/372,119

(22) Filed: Aug. 11, 1999

Related U.S. Application Data

(62) Division of application No. 09/264,049, filed on Mar. 8, 1999, now Pat. No. 6,015,104.

(60) Provisional application No. 60/079,766, filed on Mar. 20, 1998, and provisional application No. 60/079,434, filed on Mar. 26, 1998.

(51) Int. Cl.[7] ..... B02C 13/00

(52) U.S. Cl. ..... 241/81; 241/152.2

(58) Field of Search ..... 241/81, 152.2

(56) References Cited

U.S. PATENT DOCUMENTS

| | | | |
|---|---|---|---|
| 3,950,144 | 4/1976 | Gillette | 44/2 |
| 4,039,425 | 8/1977 | Neavel | 208/8 |
| 4,061,274 | 12/1977 | Williams | 241/24 |
| 4,193,554 | 3/1980 | Ansen et al. | 241/19 |
| 4,338,188 | 7/1982 | Guerre | 209/2 |
| 4,364,822 | 12/1982 | Rich, Jr. | 209/3 |
| 4,394,132 | 7/1983 | Taylor | 44/51 |
| 4,481,015 | 11/1984 | Lusch et al. | 48/202 |
| 4,484,928 | 11/1984 | Keller, Jr. | 44/1 SR |
| 4,604,105 | 8/1986 | Aquino et al. | 48/197 R |
| 4,753,660 | 6/1988 | Kellerwessel et al. | 44/51 |
| 4,784,333 * | 11/1988 | Hikake et al. | 241/5 |
| 4,795,037 | 1/1989 | Rich, Jr. | 209/3 |
| 5,500,044 * | 3/1996 | Meade et al. | 106/697 |

* cited by examiner

*Primary Examiner*—Joseph J. Hail, III
*Assistant Examiner*—William Hong
(74) *Attorney, Agent, or Firm*—Howson and Howson

(57) ABSTRACT

A process and apparatus for coal gasification plant feedstock preparation. A raw feedstock slurry is fed to a hydrocyclone which separates and provides a primary carbonaceous-rich overflow. The primary overflow is further separated by a dewatering screen into a secondary carbonaceous-rich overflow and a media bleed slurry. The secondary overflow is crushed by a crusher and a portion of the media bleed slurry is added to the crushed secondary overflow for subsequent milling and conditioning.

4 Claims, 2 Drawing Sheets

PROCESS AND APPARATUS FOR PREPARING FEEDSTOCK FOR A COAL GASIFICATION PLANT

CROSS REFERENCE TO RELATED APPLICATION

The present application is a division of application Ser. No. 09/264,049 filed on Mar. 8, 1999 now U.S. Pat. No. 6,015,104. This application claims benefit to U.S. provisional application Serial Nos. 60/079,766 Mar. 20, 1998 and 60/079,434 filed Mar. 26, 1998.

FIELD OF THE INVENTION

The present invention relates to coal gasification plant feedstock preparation.

BACKGROUND OF THE INVENTION

In the preparation of either synthetic gas or liquid fuel from coal, carbonaceous slurry is supplied to a high pressure vessel in which raw synthetic gas is produced. The raw gas is subsequently processed to yield liquid synthetic fuels. See FIG. 1. The present invention concerns the preparation of the carbonaceous feedstock slurry for the pressure vessel.

U.S. Pat. No. 4,364,822 issued on Dec. 21, 1982 to the present applicant, discloses a process for separating coal from mining refuse utilizing an autogenous non-magnetic heavy medium cyclonic separator in combination with ancillary equipment. In the process, raw input from mine tailings is screened and mixed with a heavy medium to form an aqueous slurry feedstock. The feedstock slurry flows through a primary cyclonic separator which causes a coal rich portion to exit its overflow and a refuse rich portion to exit its underflow. The underflow is screened and the fines are subsequently processed to yield carbonaceous matter. A particulary suitable hydrocyclone is disclosed in the patent for accomplishing the stated goals.

While the above-referenced process and apparatus function satisfactorily to beneficiate raw anthracite coal, culm and silt, there is a need to provide a simple, yet effective, process and apparatus for producing a coal slurry for use as a feedstock in a coal gasification plant.

OBJECTS OF THE INVENTION

With the foregoing in mind, a primary object of the present invention is to provide a novel process and apparatus for preparing feedstock for a coal gasification plant utilizing components of proven technology in an improved process which utilizes a minimum of components and is, therefore, efficient.

DESCRIPTION OF THE PREFERRED PROCESS AND APPARATUS

Figure 1:
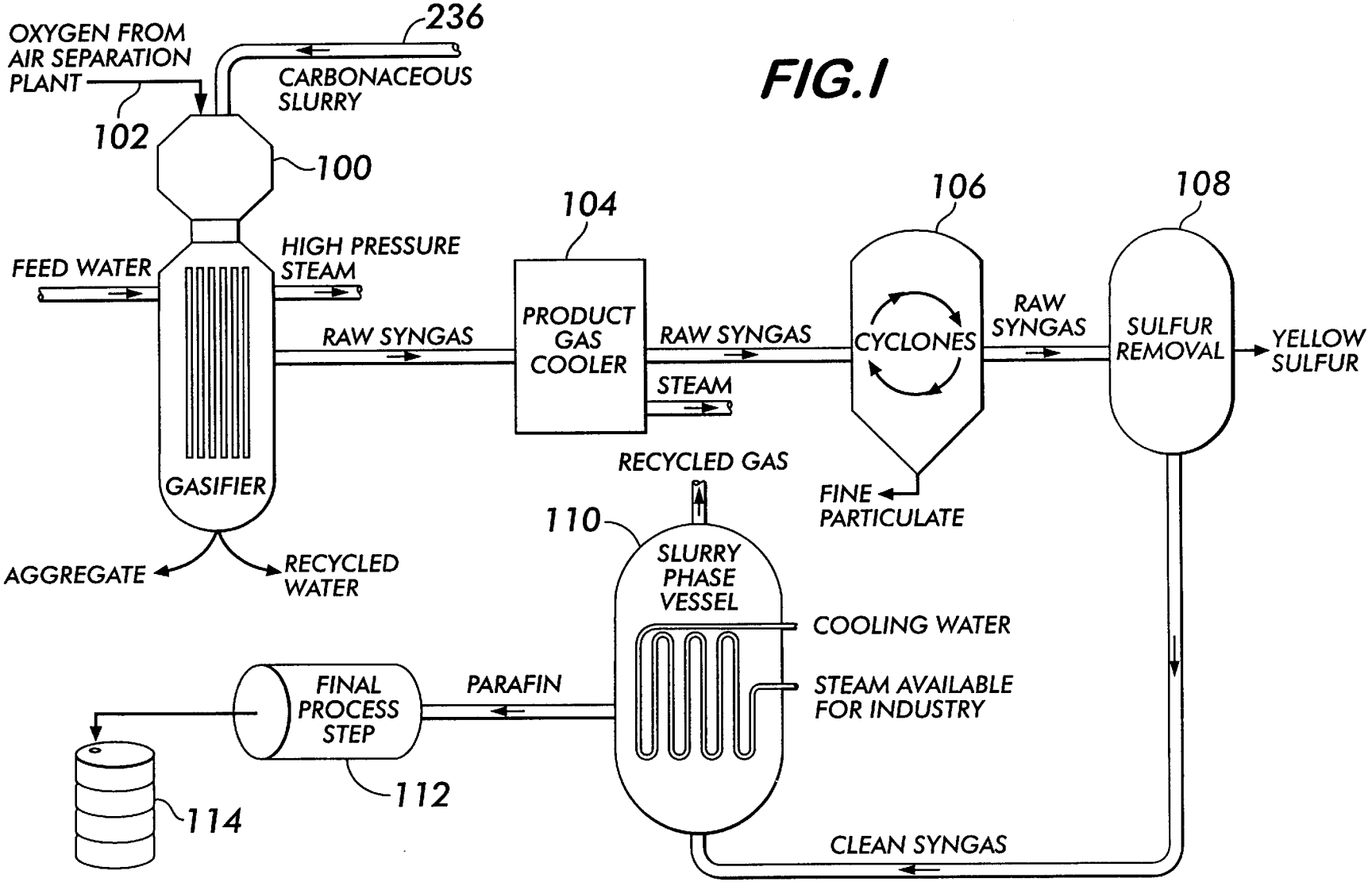
FIG. 1 illustrates schematically a coal gasification plant which utilizes a feedstock slurry produced in accordance with the process and apparatus of the present invention.

FIG. 1 illustrates schematically a coal gasification process which includes a reactor vessel, or "gasifier", 100 into which oxygen from an air separation plant (not shown) via conduit 102 and a carbonaceous slurry via piping 236 are admitted for reaction. The slurry is heated and mixed with oxygen in the gasifier 100, and a crushed glass-like byproduct, "aggregate", is removed and used in products such as concrete, mortar and plaster. Synthetic gas ("raw syngas") is produced in the reactor vessel 100 and then cooled in the "Product Gas Cooler" 104 before the raw syngas is scrubbed of fine particulates in the "Cyclones" apparatus 106. Commercial grade sulfur is removed in the "Sulfur Removal" apparatus 108, and the resulting "clean syngas" is directed into a "Slurry Phase Vessel" 110, where the clean syngas is combined with catalysts and yields a wax-like substance, "Parafin". The parafin is processed at location 112 to create a range of ultra-clean liquid fuels. At tank 114, the liquid fuel is low in particulate, aromatic, and free of sulfur, while maintaining a high Cetane Number.

The carbonaceous slurry is produced in accordance with the process and apparatus of the present invention which is based, in part, on the technology described in applicant's U.S. Pat. No. 4,364,822, the disclosure of which is incorporated herein by reference.

Figure 2:
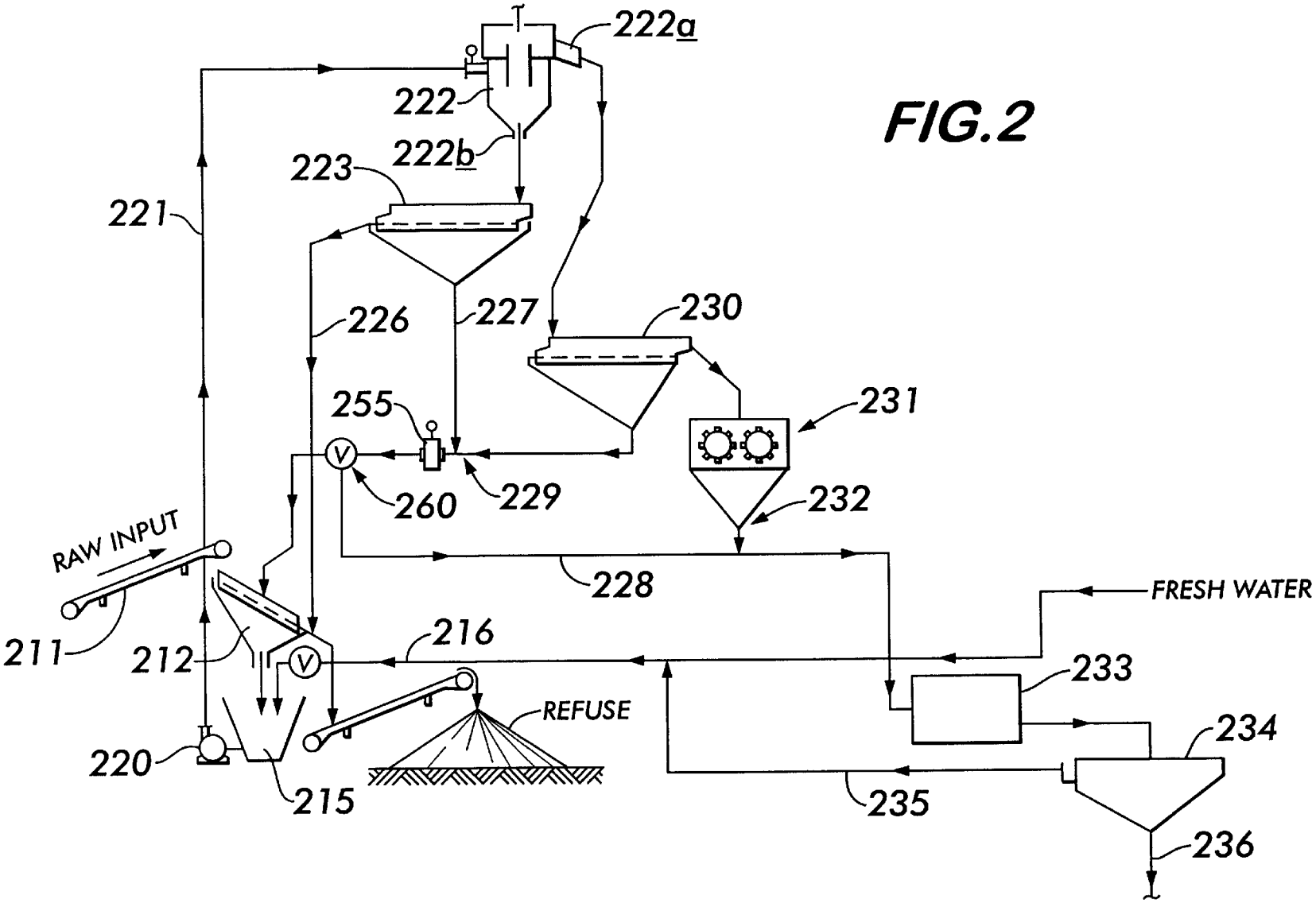
FIG. 2 is a schematic diagram of the process of the present invention utilized in producing the coal feedstock slurry for the gasification plant of FIG. 1.

Turning now to FIG. 2, coarse raw input from mine tailings is supplied by a conveyor 211 to a screen 212 which is dressed with a woven wire having a two inch square opening. The +2 inch overfeed from the screen 212 is transported by a conveyor to a refuse pile. The two inch and smaller input is charged into a sump 215 below the screen 212 from which the input and water is displaced by a pump 220 and piping 221 to a cyclonic separator 222 which functions in the manner described in the aforesaid patent to produce a coal-rich overflow slurry which exits an outlet 222*a* and a refuse-rich underflow slurry which exits an apex orifice 222*b*. The refuse-rich slurry is fed to a dewatering screen 223. The overflow from the dewatering screen 223 is fed via piping 226 to the refuse pile conveyer. The underflow from the screen 223 is fed by a piping 227 to a location upstream of a density gauge 255.

The overflow from cyclone outlet 222*a* is fed via piping to another dewatering screen 230, the underflow of which is connected via piping 229 to the underflow from the separator 223 at a point upstream of the density gauge 255. The thus combined underflows are fed via piping either to the top side of the screen 212 or through a valve 260 to other equipment to be described. The overflow from the screen 230 is fed into a crusher 231 and is conveyed via piping 232 to piping 228 which is connected downstream of the three way valve 260 and upstream to the other equipment to be described.

A milling machine 233 is provided downstream of the crusher 231 for further comminuting the product of the crusher 231. The product of the milling machine 233 is, in turn, conveyed by piping to a conditioner 234 in which the solids and water ratio of the slurry is adjusted by known means. The overflow from the conditioner 234 is returned via piping 235 to fresh water feed piping 216, or to a settling dam (not shown) and thence to the slurry sump 215.

The raw feedstock slurry admitted to the hydrocyclone 222 contains carbonaceous particles and inert particles, as described in the referenced patent. The size range of the particles may be up to about 2"×0.

After passing through the hydrocyclone 222, where a substantial fraction of the carbonaceous particles exits the overflow outlet 222*a*, the thus separated fraction is crushed in the crusher 231 to a size in the range of approximately 1"×0.

The crushed carbonaceous particles are further comminuted in the milling machine 233 to a particulate size in the range of less than approximately 150 microns.

In the conditioner 234, water is either added, or drained, to produce a carbonaceous rich slurry having a solids content in a range of about 80% to about 30%, based on the total weight of the slurry, the balance being water. However, the higher the solids content the better. Desirably, the solids content of the slurry exiting the conditioner 234 via piping 236 to the gasification plant has an ash content of up to about 30%.

The preferred hydrocyclone 222 has a plurality of elements that include a wall defining a substantially cylindrical chamber having a predetermined inside diameter, an end wall at one end of the chamber, a tangential inlet to the chamber adjacent the end wall, and a tapered end wall at the other end of the chamber. The tapered end wall has an included angle in a range of about 90 to about 140 degrees. An outlet orifice is provided in the tapered end wall, and a vortex finder depends into the cylindrical chamber and terminates at about the median thereof. The vortex finder communicates with the outlet from the hydrocyclone adjacent the end wall. For a more complete description of the structure and function of the hydrocyclone 222, reference is made to FIG. 4 of the incorporated by reference patent of the present applicant.

The above described process and apparatus functions efficiently to produce a carbonaceous slurry suitable for use as a feedstock for the aforedescribed coal gasification plant. While described in connection with the use of anthracite coal, the present invention can also be used to process bituminous, sub-bituminous, and lignite into a feedstock.

What is claimed is:

1. Apparatus for preparing feedstock for a coal gasification plant, comprising:

a cyclonic separator having a wall defining a substantially cylindrical chamber having a predetermined inside diameter, means providing a transverse end wall at one end of said chamber, means providing at least one tangential inlet into said chamber adjacent said end wall, a tapered end wall at the other end of said cylindrical chamber having an included cone angle in a range of about 90 degrees to about 140 degrees, means providing an orifice in said tapered wall adjacent the apex thereof, a vortex finder depending into said cylindrical chamber and terminating at about the median thereof, said vortex finder communicating with an outlet from said chamber, the inside diameter of said cylindrical chamber being slightly less than its axial length;

a dewatering screen connected to said separator outlet, said dewatering screen producing a primary overflow slurry and a secondary underflow slurry;

a crusher connected to said dewatering screen for crushing solid matter in said overflow slurry to a maximum size of about 1"×0;

a milling machine connected to said crusher for pulverizing the crushed solid matter in said overflow slurry to a particulate size of less than about 150 microns; and a conditioner connected to said milling machine for enabling the solids content of the slurry overflow to be adjusted to a predetermined level before being fed to the gasification plant.

2. Apparatus according to claim 1, further comprising piping connecting the secondary underflow slurry from the dewatering screen to said primary overflow slurry crushed by the crusher.

3. Apparatus according to claim 2, further comprising piping connecting an underflow from said cyclonic separator and said secondary underflow slurry from said dewatering screen to a sump for providing non-magnetic solid particulate matter to be mixed with raw feedstock and fed to the cyclonic separator.

4. Apparatus according to claim 1, wherein said conditioner adjusts said solids content to a range of about 80% to about 30% based on the total weight of the slurry, the balance being water.

* * * * *